US008786498B2

(12) United States Patent
Chiang et al.

(10) Patent No.: US 8,786,498 B2
(45) Date of Patent: Jul. 22, 2014

(54) ANTENNA AND METHOD FOR MAKING SAME

(75) Inventors: Chwan-Hwa Chiang, New Taipei (TW); Jia-Lin Chen, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 187 days.

(21) Appl. No.: 13/474,829

(22) Filed: May 18, 2012

(65) Prior Publication Data

US 2013/0120196 A1 May 16, 2013

(30) Foreign Application Priority Data

Nov. 11, 2011 (CN) ..... 2011 1 0356854

(51) Int. Cl.
*H01Q 1/38* (2006.01)
*H01Q 1/40* (2006.01)
*H01Q 1/24* (2006.01)

(52) U.S. Cl.
USPC ..... 343/700 MS; 343/702; 343/873

(58) Field of Classification Search
CPC ..... H01Q 1/38; H01Q 1/40; H01Q 1/242
USPC ..... 343/700 MS, 702, 873, 713
See application file for complete search history.

(56) References Cited

U.S. PATENT DOCUMENTS 4,141,011 A * 2/1979 Boaz ..... 343/713
8,203,491 B2 * 6/2012 Yang et al. ..... 343/702

* cited by examiner

*Primary Examiner* — Hoang V Nguyen
(74) *Attorney, Agent, or Firm* — Novak Druce Connolly Bove + Quigg LLP

(57) ABSTRACT

An antenna includes a transparent substrate, a silver layer directly formed on a surface of the transparent substrate, an ink layer made of an electroconductive ink directly formed on the silver layer, and a transparent protective layer directly formed on the silver layer. The silver layer forms a desired antenna pattern and has a feed portion and grounding portion. The ink layer covers the feed portion and the grounding portion. The protective layer covers the silver layer besides the feed portion and the grounding portion. A method for making the antenna is also described.

19 Claims, 2 Drawing Sheets

ANTENNA AND METHOD FOR MAKING SAME

BACKGROUND

1. Technical Field

The present disclosure relates to antennas and a method for making the antennas.

2. Description of Related Art

A typical antenna for an electronic device is usually a patterned copper sheet integral with a laminate manufactured to be further integrated with a plastic housing by a conventional insert molding labeling method. However, the patterned copper sheet typically has a thickness exceeding 0.3 millimeters (mm), increasing the thickness and size of the molded housing.

Therefore, there is room for improvement within the art.

BRIEF DESCRIPTION OF THE FIGURES

Many aspects of the disclosure can be better understood with reference to the following figures. The components in the figures are not necessarily drawn to scale, the emphasis instead being placed upon clearly illustrating the principles of the disclosure.

DETAILED DESCRIPTION

Figure 1:
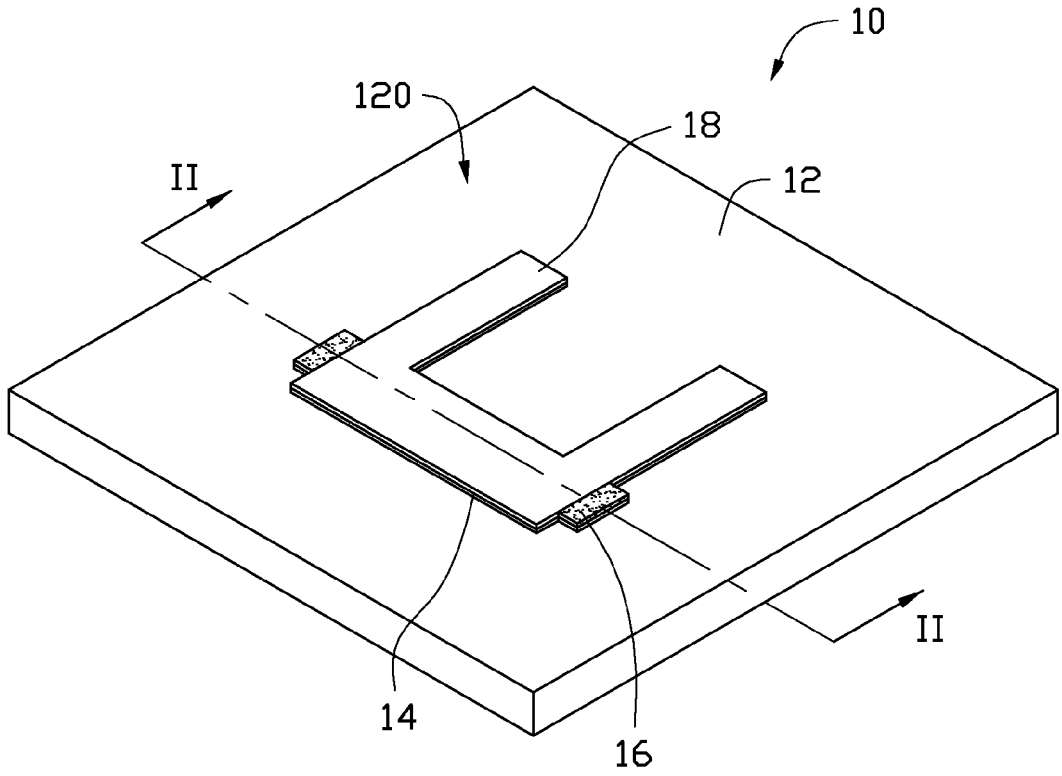
FIG. 1 is a plane view of an exemplary embodiment of an antenna.

FIG. 1 shows an antenna 10 according to an exemplary embodiment. The antenna 10 includes a transparent substrate 12, a silver layer 14 directly formed on the substrate 12, an ink layer 16 directly formed on the silver layer 14, and a protective layer 18 directly formed on the silver layer 14. As used in this disclosure, "directly" means a surface of one layer contacts a surface of another layer.

The substrate 12 may be made of a transparent plastic, such as polycarbonate (PC) or polymethyl methacrylate (PMMA). The substrate 12 may also be made of transparent glass. In an exemplary embodiment, the substrate 11 is made of polymethyl methacrylate. The substrate 12 may be a display window for electronic devices. Also, the substrate 12 may be a front windshield for vehicles.

Figure 2:
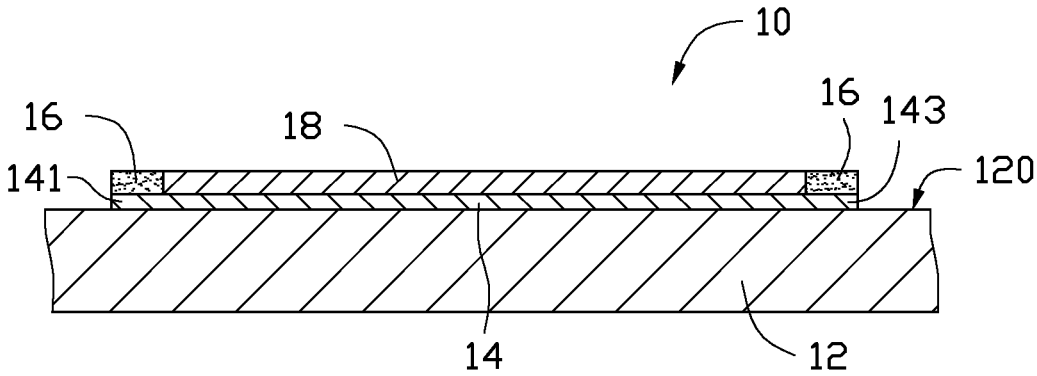
FIG. 2 is a cross-sectional view of the antenna shown in FIG. 1 taken along line II-II.

The silver layer 14 is formed on a surface 120 of the substrate 12, providing a desired antenna pattern on the substrate 12. Referring to FIG. 2, the silver layer 14 includes a feed portion 141 and a grounding portion 143. The feed portion 141 and the grounding portion 143 are used to electrically connect with a circuit board of an electronic device using the antenna 10. Feeding signals from the circuit board are input into the antenna 10 via the feed portion 141. The silver layer 14 may be transparent or translucent. To ensure a high transparency, the thickness of the silver layer 14 may be about 5 nm to about 25 nm. The sheet resistance of the silver layer 14 may be about 1.9 ohms per square (Ω/sq) to about 2.1 Ω/sq, ensuring a high electrical conductivity of the silver layer 14.

The ink layer 16 may cover the feed portion 141 and the grounding portion 143. The ink layer 16 may be made of an electroconductive ink mainly comprising organic polymer and electroconductive substance. The organic polymer can be a copolymer resin of chlorinated alkene, alkene acetate, and methacrylic hydroxyl. The electroconductive substance may be micron-sized silver powder or copper wrapped silver powder. The ink layer 16 may have a thickness of about 1 μm to about 50 μm, with a transmission of visible light greater than 85%. The ink layer 16 may protect the feed portion 141 and the grounding portion 143 from oxidization by ambient environmental conditions. Moreover, the ink layer 16 is electroconductive and therefore does not influence electrical connections between the feed portion 141, the grounding portion 143, and the circuit board.

The protective layer 18 may cover the entire silver layer 14 except the feed portion 141 and the grounding portion 143. The protective layer 18 is transparent and may be made of transparent resin paint, such as ultraviolet curable resin paint. In one exemplary embodiment, the protective layer 18 is made of an acrylic polyurethane paint. The thickness of the protective layer 18 may be about 5 μm to about 25 μm. The protective layer 18 may protect corresponding portions of the silver layer 14 (the feed portion 141 and the grounding portion 143 not included) from oxidization caused by contacting with air.

The antenna 10 (including the substrate 12) has an average transmission of visible light greater than 40%. In case of a substrate 12 made of PMMA, the transmission of light with a wavelength of about 550 nm of the antenna is about 45% to about 55%.

If the thickness of the silver layer 14 is greater than 25 nm, the average transmission of visible light of the antenna 10 is lower than 40%. When the thickness of the silver layer 14 is less than 5 nm, the sheet resistance of the silver layer 14 is greater than 2.1 Ω/sq. Thus, the electric conductivity of the antenna 10 can be greatly decreased.

An exemplary method for making the antenna 10 may include the following steps.

The substrate 12 is provided.

The substrate 12 may be cleaned to remove impurities such as grease or dirt from the substrate 12. Then, the substrate 12 is dried.

A desired antenna pattern is formed on the substrate 12 using a silver layer 14. The silver layer 14 has the feed portion 141 and the grounding portion 143. The silver layer 14 may partially cover the substrate 12. Forming the silver layer 14 may include the following steps:

The substrate 12 is masked using a first masking film (not shown). The first masking film has an opening. The opening has a shape of the desired antenna pattern.

A vacuum sputtering process is applied on the substrate 12 with the first masking film, forming the silver layer 14 on the substrate 12. The silver layer 14 may initially cover the first masking film and portions of the substrate 12 exposed from the opening of the first masking film. The vacuum sputtering process is implemented in a chamber of a conventional sputtering machine (not shown). The substrate 12 masked using the first masking film is held on a rotating bracket in the chamber. The speed of the rotating bracket is between about 2.5 revolutions per minute (rpm) and about 3.5 rpm. The chamber is evacuated to maintain an internal pressure in a range from about $6.5\times10^{-3}$ Pa to about $9.5\times10^{-3}$ Pa and the inside of chamber maintains a temperature between about 15° C. and about 55° C. Argon may be fed into the chamber as a sputtering gas. The argon may create a partial pressure of about 0.2 Pa to about 0.6 Pa in the chamber. About 1.0 kW-4.0 kW of power is applied to a silver target fixed in the chamber, depositing the silver layer 14 as an electroconductive layer. The deposition of the silver layer 14 may take about 15 seconds to about 45 seconds. The silver layer 14 has a thickness of about 5 nm to about 25 nm.

The first masking film and portions of the silver layer 14 formed on the first masking film are removed, the remainder of the silver layer 14 covering the substrate 12 forming a desired antenna pattern.

The protective layer 18 is formed on the silver layer 14. The protective layer 18 covers the entire silver layer 14 except the feed portion 141 and the grounding portion 143. Forming the protective layer 18 may include the following step. The feed portion 141 and the grounding portion 143 are masked using a second masking film (not shown). The substrate 12 with the silver layer 14 is sprayed with a transparent resin paint layer. The transparent resin paint layer covers at least the silver layer 14 and the second masking film. The second masking film and portions of the transparent resin paint layer formed thereon are removed, the remainder of the transparent resin paint layer forming the protective layer 18.

The ink layer 16 may be formed on the feed portion 141 and the grounding portion 143 by printing, for example.

The first masking film and the second masking film may be adhesive tape.

The total thickness of the antenna 10 is small and the visible light transmissible capability is also high. Thus, the antenna 10 can be mounted on transparent members without occupying much space, such as display windows of electronic devices and front windshields of vehicles.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. An antenna, comprising:

a transparent substrate;

a silver layer directly formed on a surface of the transparent substrate, the silver layer forming a desired antenna pattern and having a feed portion and grounding portion;

an ink layer directly formed on the silver layer and covering the feed portion and the grounding portion, the ink layer made of an electroconductive ink; and a protective layer directly formed on the silver layer and covering the entire silver layer except the feed portion and the grounding portion, the protective layer being transparent.

2. The antenna as claimed in claim 1, wherein the thickness of the silver layer is about 5 nm to about 25 nm

3. The antenna as claimed in claim 1, wherein the sheet resistance of the silver layer is about 1.9 Ω/sq to about 2.1 Ω/sq.

4. The antenna as claimed in claim 1, wherein the antenna has an average transmission of visible light greater than 40%.

5. The antenna as claimed in claim 1, wherein the transparent substrate is made of plastic.

6. The antenna as claimed in claim 5, wherein the transparent substrate is made of polymethyl methacrylate.

7. The antenna as claimed in claim 6, wherein the transmission of light with a wavelength of about 550 nm of the antenna is about 45% to about 55%.

8. The antenna as claimed in claim 1, wherein the transparent substrate is made of glass.

9. The antenna as claimed in claim 1, wherein the electroconductive ink mainly comprises organic polymer and electroconductive substance.

10. The antenna as claimed in claim 9, wherein the organic polymer is a copolymer resin of chlorinated alkene, alkene acetate, and methacrylic hydroxyl.

11. The antenna as claimed in claim 9, wherein the electroconductive substance is micron-sized silver powder or copper wrapped silver powder.

12. The antenna as claimed in claim 1, wherein the ink layer has a thickness of about 1 μm to about 50 μm, with a transmission of visible light greater than 85%.

13. A method for making an antenna, comprising:

providing a transparent substrate;

forming a silver layer defining a desired antenna pattern on the substrate, the silver layer having a feed portion and a grounding portion;

forming a transparent protective layer on the silver layer, the protective layer covering the entire silver layer except the feed portion and the grounding portion;

forming an ink layer on the feed portion and the grounding portion, the ink layer made of an electroconductive ink.

14. The method as claimed in claim 13, wherein the step of forming the silver layer includes the steps of:

masking the substrate using a first masking film, the first masking film having an opening, the opening having a shape of the desired antenna pattern;

vacuum sputtering the silver layer on the substrate, the silver layer initially covering the first masking film and portions of the substrate exposed from the opening;

removing the first masking film and portions of the silver layer formed thereon.

15. The method as claimed in claim 14, wherein the first masking film is adhesive tape.

16. The method as claimed in claim 14, wherein during the vacuum sputtering process, the substrate masked using the first masking film is held on a rotating bracket in a chamber of a sputtering machine; the speed of the rotating bracket is between about 2.5 rpm and about 3.5 rpm; the chamber maintains an internal pressure in a range from about $6.5\times10^{-3}$ Pa to about $9.5\times10^{-3}$ Pa and the inside of chamber maintains a temperature between about 15° C. and about 55° C.; argon is fed into the chamber to create a partial pressure of about 0.2 Pa to about 0.6 Pa in the chamber; about 1.0 kW-4.0 kW of power is applied to a silver target fixed in the chamber; the vacuum sputtering process takes about 15 seconds to about 45 seconds.

17. The method as claimed in claim 13, wherein the step of forming the protective layer includes the steps of:

masking the feed portion and the grounding portion by a second masking film;

spraying a transparent resin paint layer on the substrate, the transparent resin paint layer covering at least the silver layer and the second masking film;

removing the second masking film and portions of the transparent resin paint layer formed thereon.

18. The method as claimed in claim 17, wherein the second masking film is adhesive tape.

19. The method as claimed in claim 13, wherein the silver layer has a thickness of about 5 nm to about 25 nm.

* * * * *